US005525118A

United States Patent [19]

Mock

[11] Patent Number: 5,525,118

[45] Date of Patent: Jun. 11, 1996

[54] WEIGHTED CORE FOR BOWLING BALL AND METHOD OF MAKING SAME

[76] Inventor: Elden G. Mock, 3312 Hamner Ave., Norco, Calif. 91760

[21] Appl. No.: 394,511

[22] Filed: Feb. 27, 1995

Related U.S. Application Data

[63] Continuation-in-part of Ser. No. 223,050, Apr. 5, 1994, abandoned.

[51] Int. Cl.[6] ..... A63B 37/06

[52] U.S. Cl. ..... 473/125; 273/DIG. 20; 473/126

[58] Field of Search ..... 473/125, 126; 273/DIG. 20, 59 B, 220, 230, 65 EC; 446/126

[56] References Cited

U.S. PATENT DOCUMENTS

| | | | |
|---|---|---|---|
| 4,328,967 | 5/1982 | Orlando et al. | 473/125 |
| 4,352,255 | 10/1982 | Warchime | 446/126 |
| 5,098,096 | 3/1992 | Gentiluomo | 473/125 |
| 5,125,656 | 6/1992 | Fabanich | 473/126 |
| 5,215,304 | 6/1993 | Pinel | 473/126 |

*Primary Examiner*—Vincent Millin
*Assistant Examiner*—William M. Pierce
*Attorney, Agent, or Firm*—G. Donald Weber, Jr.

[57] ABSTRACT

A two-piece bowling ball that combines a dynamic core and a urethane cover to thereby permit bowlers to utilize the bowling ball under a variety of bowling lane conditions. The improved bowling ball construction permits the dynamic rotation and revolutions of the ball to produce a true arc toward the pin target.

19 Claims, 1 Drawing Sheet

WEIGHTED CORE FOR BOWLING BALL AND METHOD OF MAKING SAME

This application is a continuation-in-part of application Ser. No. 08/223,050, filed Apr. 5, 1994, now abandoned.

BACKGROUND

1. Field of the Invention

This invention is directed to a bowling ball, in general, and to a bowling ball comprising a dynamic core of a unique shape and formulation as well as a method of making same wherein portions of the dynamic core have different densities and specific gravities, in particular.

2. Prior Art

There are many types of bowling balls known in the industry. These can be fabricated of solid core or composite materials. They can be fabricated of hard rubber or a type of plastic such as, but not limited to, urethane.

Many bowling balls are constructed of concentric spherical arrangements in order to establish and maintain certain characteristics including size and weight constraints in accordance with sanctioned league play.

Recently, bowling balls have been fabricated with internal structures of unique shapes and configurations in order to attempt to cause the ball to "track" more consistently. That is, by inserting weights and counterweights, the ball can traverse a more consistent path toward the pins. This type of construction takes into account the possible inconsistencies in the materials which form the ball and, as well, the weight differential which occurs when the thumb and finger holes are drilled into the ball. While numerous arrangements for fabrication and design of balance and counterbalance devices are known in the art, improvements are continually being sought and designed.

SUMMARY OF THE INVENTION

This invention is directed to a bowling ball which combines a dynamic core and a urethane cover. The dynamic core includes a plurality of weight components which are mounted to a central core (or weight block). The weight components have a relatively higher density and specific gravity than the central core. The dynamic core is then encapsulated in a spherical unit of resin materials which is then coated with an outer covering of urethane or other material to complete the construction of the bowling ball. The outer covering has a relatively higher density and specific gravity than the spherical unit, both of which have a relatively higher density and specific gravity than the central core.

DESCRIPTION OF THE PREFERRED EMBODIMENT

Figure 1:
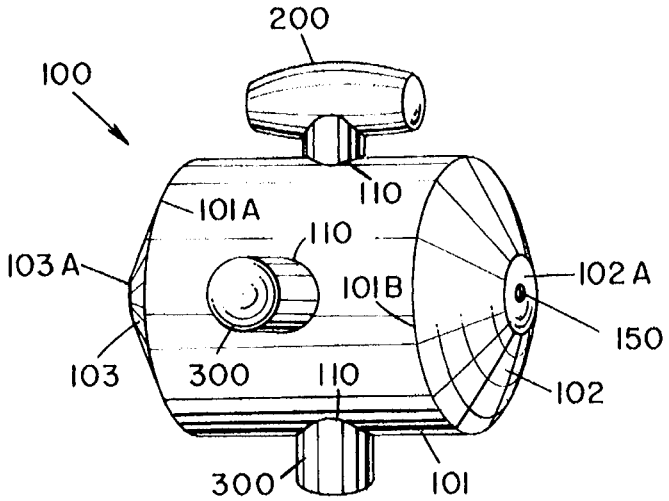
FIG. 1 is a perspective representation of the dynamic core of the instant invention.

Referring now to FIG. 1, there is shown a preferred embodiment of the dynamic core 100 of the instant invention.

The dynamic core 100 includes the generally cylindrical weight block 101. The block 101, which is generally cylindrical, includes tapered ends 102 and 103. These tapered ends can be relatively flat or pointed as the case may be.

In the preferred embodiment, the tapered ends 102 and 103 take the form of truncated pyramids with flattened ends 102A and 103A, respectively. Typically, but not limitatively, the areas of the flattened ends 102A and 103A are approximately the same dimensions as the stems of the weights as described hereinafter.

In the preferred embodiment, the weight block 101 is approximately 4 inches in diameter and approximately 5 5/16 inches in length (end-to-end). The length of the outer perimeter of body 101 is approximately 4 ½inches between the edges or shoulders 101A and 101B of the tapered ends.

The truncated end portions 102A and 103A are generally approximately 1 inch in diameter. Likewise, the weight receiving apertures 110 and 111 are also approximately 1 inch in diameter. The apertures 110 and 111 are on the order of 0.009 to 0.25 inch in depth. In a preferred embodiment, the cylinder 101 is fabricated of barium (or barium sulphate) with a specific gravity of about 4, limestone (or calcium carbonate) with a specific gravity of about 2.6, glass micro spheres, casting resins, and benzol peroxide all of which have relatively low specific gravities, at about 2%. In one embodiment, the barium and limestone are mixed together at a 2:1 ratio which provides a mixtures with moderately high specific gravity and density. However, various formulae can be utilized to obtain desired weight configurations, e.g. 15 to 16 pounds, or the like. (Of Course, bowling balls of even 8 pounds are contemplated.) The casting resins and benzol peroxide are then added to that mixture. This forms a solution with a specific gravity in the range of 1.9 to 2.1 which is poured into a mold of the size and shape described thereby to produce the core 101 when the solution has hardened. At room temperature this process, typically, requires about 6–8 minutes. The limestone/barium mixture controls the density thereof and, thus, the weight of the core and the weights. Typically, the density and specific gravity of this core has a range of 1.9 to 2.1 dependent upon the mixture of components noted above.

Fixed to the surface of the cylinder 101 is a top weight 200. The top weight 200 is generally T-shaped in configuration. The top weight 200 is joined to the cylinder 101 in that portion of the core 100 which will form the top of the core in the ultimate bowling ball configuration. In some instances, the T-shaped top weight is used because it provides,greater flexibility or choice of location in the process of drilling holes in the ultimate bowling ball.

The upright or stem portion of the top weight 200 is joined to the surface of cylinder 101 by insertion into an aperture 110 which is formed in the surface. This aperture can be formed by drilling, molding, routing or the like.

A plurality of side weights 300 are mounted around the perimeter of the cylinder 101. In the preferred embodiment, the top weight 200 and the side weights 300 are mounted at quadrature around the perimeter of the cylinder 101. That is, each of the weights is located about 90° from the others. In addition, the perimeter of the cylinder 101 is approximately equidistant from the end portions 102A and 103A of the cylinder.

Once again, the side weights 300 are mounted in openings 111 which are formed in the periphery of the cylinder 101 in the same fashion as the aperture 110. The weights are adhered to the cylinder 101 by means of a suitable adhesive such as epoxy or the like. The counterweights 200 and 300 are made of pure barium plus casting resins and placed in appropriately sized forms. Thus, the weights 200 and 300 have a specific gravity and density of about 2.2 to 2.7 depending upon the mixture of components. Again, these units cure in about 6–8 minutes. The weights are affixed to the cylinder walls with an adhesive comprising barium and casting resin.

While not essential to the ultimate construction of the finished bowling ball, per se, a positioning hole 150 can be formed or drilled into end 102A or 103A. The core can then be placed on a spindle (not shown) in a mold (not shown) for consistent positioning of the dynamic core in the final molding steps.

Figure 2:
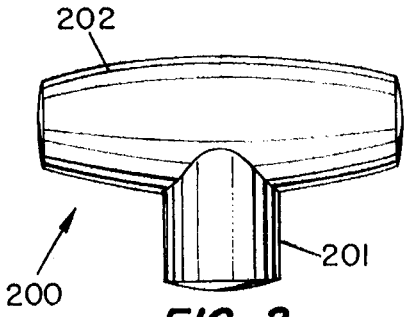
FIG. 2 is a perspective view of one embodiment of the top weight of the dynamic core of the instant invention.

Referring now to FIG. 2, there is shown a perspective view of the top weight 200. The weight 200 has a generally T-shaped configuration. The vertical bar or stem 201 of the weight 200 is, generally, cylindrical in configuration. Of course, other shapes can be utilized, if so desired. The main body 202 of the weight 200 is, generally, ellipsoidal in configuration. The stem 201 is, generally, integrally formed with the main body 202 at about the midpoint thereof. The ends of the body 202 are generally flattened to establish desired size and weight characteristics.

In a preferred embodiment, the stem portion 201 is approximately 1 inch in diameter and approximately ¾ inch long. The ellipsoidal body 202 is approximately 3 inches long and tapers from approximately 1⅛ inches at the midpoint (to approximately ¾inch in diameter at the ends thereof).

The upper surface of body 202 is designed to have a radius of curvature based upon a radius of 7 ¼inches from the center of the core. This taper may, but is not required to, approximately follow the outer curvature of the bowling ball. The inner surface of the body 201 may be tapered or radiused as deemed appropriate.

It should be understood that these dimensions are illustrative only. The sizes and shapes of top weights 200 which can be fabricated can vary so long as there is no interference with the shape of the ultimate bowling ball. For example, depending upon the design criteria, the length of the stem 201 can be as short as ¼ of an inch while the overall diameter of the body 202 can be as much as 1⅝ inches. However, the length of the body 202 remains approximately 3 inches while the radius of curvature of the outer surface remains approximately 7¼ inches. The different sizes of the top weights establish different inertial characteristics and, thus, tracking for the completed bowling ball.

Figure 3:
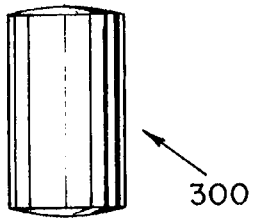
FIG. 3 is a perspective view of the balancing weights of the instant invention.

Referring now to FIG. 3, there is shown a representative side weight 300. The side weights 300 are, generally, cylindrical in configuration with a slight radius at the outer end thereof. The flattened inner end thereof is inserted into the apertures 111 in cylinder 101 shown in FIG. 1.

The side weight 300 is, typically, a cylinder which is approximately 1 inch in diameter and approximately 1⅞ inches long with the outer end having the radius of 7¼ inches. Other shapes can be utilized, but a cylindrical shape is preferred for convenience. The side weights are, typically, fabricated of the same material as the top weight 200.

Figure 4:
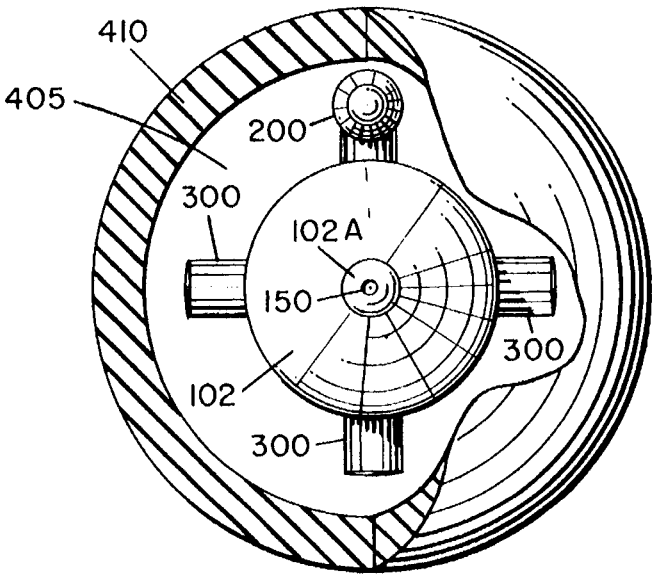
FIG. 4 is a cross sectional view of a representative bowling ball formed using the techniques of the instant invention.

Referring now to FIG. 4, there is shown a cross-sectional view of a representative bowling ball 400 including the core 100 of the instant invention. In the bowling ball 400, the core 100 comprises the cylinder 101, the top weight 200 and the side weights 300. These weights are adhered to or joined with the cylinder 101 at quadrature, as noted above.

The dynamic core 100, i.e. cylinder 101 with weights 200 and 300, is placed in a suitable mold which is filled with a composite which includes glass crystals or hollow microspheres having a specific gravity of about 0.17 and casting resin having a specific gravity of about 1.1. By altering the ratio of crystals to spheres and, as well, the amount of crystals and/or spheres relative to casting resin, the overall weight of the bowling ball can be raised. Moreover, the amount of casting resin (or even calcium carbonate) inhibits the separation of the glass crystals or microspheres from the mixture by increasing the viscosity thereof. This composite surrounds the dynamic core 100 and forms a spherical component 405 which is about 7¼ inches in diameter. The spherical component or outer core has a specific gravity of about 0.5 to 1.0. The spherical component is then coated, in a conventional manner, with an outer layer 410 of urethane, hard rubber or the like. The outer shell 410 is, typically, about 9/16 to ⅝ inch thick and has a specific gravity of about 1 to 1.2. The ball is then cured and completed in accordance with conventional techniques. It is ready for stamping of identification, drilling of finger and thumb holes and the like.

Thus, there is shown and described a unique design and concept of a two-piece bowling ball. The outer shell and the inner core are, generally, uniform. However, the dynamic core, especially the weights with the relatively high specific gravity (i.e. relative weight) controls the tracking line of the bowling ball. The particular configuration shown and described herein relates to a method of making a bowling ball comprising a dynamic core of a unique shape and formulation. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A core for a bowling ball comprising, a central core member, said central core member has a generally cylindrical configuration, said central core member fabricated of a composite having a first specific gravity, and a plurality of weights equally spaced around a perimeter of said central core member, said weights fabricated of a composite having a second specific gravity which is higher than said first specific gravity.

2. The core recited in claim 1 wherein, at least one of said weights has a generally T-shaped configuration.

3. The core recited in claim 2 wherein, at least one of said weights has a generally cylindrical configuration.

4. The core recited in claim 1 wherein, said plurality of weights is distributed in quadrature around the perimeter of said core member.

5. The core recited in claim 1 wherein, said central core member is fabricated of a composite including barium, limestone, casting resins and benzol peroxide.

6. The core recited in claim 5 wherein, said composite includes glass crystals.

7. The core recited in claim 5 wherein, said composite includes glass microspheres.

8. The core recited in claim 1 wherein, each of said weights is fabricated of a composite including barium and casting resins.

9. A bowling ball including, a central core member, said central core member fabricated of a composite having a first specific gravity, said central core member has a generally cylindrical configuration, a plurality of weights equally spaced around the perimeter of the core member, said weights fabricated of a composite having a second specific gravity which is higher than said first specific gravity, a spherical component surrounding said central core and said plurality of weights, and an outer shell surrounding said spherical component.

10. The core recited in claim 9 wherein, said spherical component includes casting resins.

11. The bowling ball recited in claim 9 wherein, said weights are distributed around a perimeter of said core and adjacent to a perimeter of said outer shell of said bowling ball.

12. The method recited in claim 9 wherein, said outer shell is formed of urethane.

13. The bowling ball recited in claim 9 wherein, said spherical component is formed of material having lower specific gravity than either of said central core member and said weights.

14. A method of making a bowling ball with a dynamic core comprising, forming a generally cylindrical central core of a first composite, and adding a plurality of weights fabricated of a second composite at equally spaced locations around the perimeter surface of said generally cylindrical central core, said second composite has a greater specific gravity than said first composite.

15. The method recited in claim 14 wherein, said central core is formed by mixing barium, limestone, casting resins and benzol peroxide;

placing the mixed components in a mold; and allowing said mixed components to cure to a solid body.

16. The method recited in claim 14 wherein, said weights are formed by mixing barium, casting resins and benzol peroxide;

placing the mixed components in a mold; and allowing said mixed components to cure to a solid body.

17. The method recited in claim 14 including, placing said central core and said plurality of weights in a spherical mold, pouring a composite including at least casting resin into said spherical mold, and curing said composite.

18. The method recited in claim 17 including, forming an outer shell around said cured composite.

19. The method recited in claim 14 including the steps of:

encapsulating said core and said weights in a spherical body having a specific gravity which is not greater than said core, and surrounding said spherical body with an outer shell of relatively hard material.

* * * * *